US011576423B2

(12) United States Patent
Mishra et al.

(10) Patent No.: US 11,576,423 B2
(45) Date of Patent: Feb. 14, 2023

(54) SMOKELESS TOBACCO PRODUCT

(71) Applicant: ALTRIA CLIENT SERVICES LLC, Richmond, VA (US)

(72) Inventors: Munmaya K. Mishra, Manakin Sabot, VA (US); Frank Scott Atchley, Midlothian, VA (US); James Arthur Strickland, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 175 days.

(21) Appl. No.: 13/922,887

(22) Filed: Jun. 20, 2013

(65) Prior Publication Data

US 2014/0000634 A1 Jan. 2, 2014

Related U.S. Application Data

(60) Provisional application No. 61/662,035, filed on Jun. 20, 2012.

(51) Int. Cl.

| | |
|---|---|
| ***A24B 15/14*** | (2006.01) |
| ***A24B 15/32*** | (2006.01) |
| ***A24B 15/16*** | (2020.01) |
| ***A24B 13/00*** | (2006.01) |

(52) U.S. Cl.

CPC ..... *A24B 15/14* (2013.01); *A24B 13/00* (2013.01); *A24B 15/16* (2013.01); *A24B 15/32* (2013.01)

(58) Field of Classification Search

None

See application file for complete search history.

(56) References Cited

U.S. PATENT DOCUMENTS

| | | | | |
|---|---|---|---|---|
| 4,516,590 | A | 5/1985 | Teng | |
| 4,528,993 | A | 7/1985 | Sensabaugh et al. | |
| 4,606,357 | A * | 8/1986 | Dusek | A24B 15/16 131/359 |
| 4,660,577 | A | 4/1987 | Sensabaugh et al. | |
| 4,848,373 | A | 7/1989 | Lenkey | |
| 4,987,907 | A | 1/1991 | Townend | |
| 5,372,149 | A | 12/1994 | Roth et al. | |
| 2004/0118422 | A1 | 6/2004 | Lundin et al. | |
| 2005/0178398 | A1 | 8/2005 | Breslin et al. | |

(Continued)

FOREIGN PATENT DOCUMENTS

| | | |
|---|---|---|
| GB | 1203308 | 8/1970 |

OTHER PUBLICATIONS

Kuo, Poly(dimethylsiloxane), 1999, Polymer Data Handbook, p. 411 -435.*

(Continued)

*Primary Examiner* — Phu H Nguyen

(74) *Attorney, Agent, or Firm* — Harness, Dickey & Pierce, P.L.C.

(57) ABSTRACT

Some embodiments of a smokeless tobacco system include one or more silicone smokeless tobacco products configured to generally retain their shape during processing, shipping, and consumer handling. In particular embodiments, each silicone smokeless tobacco product can comprise a moist smokeless tobacco in combination with a silicone binder such that the final product has tobacco exposed along an exterior surface and is configured to have material properties providing improved handling, an improved mouth feel, and a satisfying flavor profile.

21 Claims, 11 Drawing Sheets

(56) References Cited

U.S. PATENT DOCUMENTS

| | | | | |
|---|---|---|---|---|
| 2008/0209586 | A1 | 8/2008 | Nielsen et al. | |
| 2010/0068821 | A1* | 3/2010 | St. Germain | G01N 33/1826 436/140 |
| 2010/0163062 | A1* | 7/2010 | Atchley | A24B 13/00 131/119 |
| 2012/0031414 | A1* | 2/2012 | Atchley et al. | 131/118 |
| 2012/0031416 | A1 | 2/2012 | Atchley et al. | |

OTHER PUBLICATIONS

International Search Report and Written Opinion in International Application No. PCT/US2013/046793, dated Jan. 7, 2014, 9 pages.
Tso, *Tobacco, Production, Chemistry and Technology*, Davis & Nielsen, eds., 1999, Chapter 1, 1-31.

* cited by examiner

SMOKELESS TOBACCO PRODUCT

CROSS-REFERENCE TO RELATED APPLICATIONS

This application claims priority to U.S. Provisional Application Ser. No. 61/662,035, filed on Jun. 20, 2012, which is hereby incorporated by reference.

TECHNICAL FIELD

This disclosure relates to products including smokeless tobacco and a silicone binder. Methods of making and using these products are also described.

BACKGROUND

Smokeless tobacco is tobacco that is placed in the mouth and not combusted. There are various types of smokeless tobacco including: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between an adult tobacco consumer's cheek and gum. Snus is a heat treated smokeless tobacco. Dry snuff is finely ground tobacco that is placed in the mouth or used nasally.

SUMMARY

A silicone smokeless tobacco product includes smokeless tobacco and a silicone binder. The silicone binder secures the smokeless tobacco, yet contains smokeless tobacco along an exterior surface of the product. The silicone smokeless tobacco product is configured to retain its shape during processing, shipping, and consumer handling. The silicone smokeless tobacco product can include a moist smokeless tobacco in combination with a silicone binder such that the product has improved handling, improved mouth feel, and satisfying flavor profile. In some embodiments, the silicone smokeless tobacco product can have an elasticity allowing an adult tobacco consumer to work the product within the mouth.

The silicone smokeless tobacco product can have a predetermined shape. In some embodiments, the product is a film. In other embodiments, the product can have defined three-dimensional shape. In still other embodiments, the product can include a stick having a silicone/smokeless tobacco coating. In some embodiments, the product can include a shaped body formed of a silicone/smokeless tobacco combination and an attached rod or tube. In other embodiments, the product can have a random shape.

In some implementations, a system can include a plurality of the silicone smokeless tobacco products packaged into a container, where each of the silicone smokeless tobacco products has a substantially similar shape and provides a substantially similar, predetermined portion of tobacco to an adult tobacco consumer. Such a system can permit an adult tobacco consumer to receive consistent portions of tobacco (e.g., with each deposit of a product portion in the mouth) while also experiencing the tactile and flavor benefits of having the smokeless tobacco externally exposed on the article (e.g., not impeded by a paper-like pouch or sachet). Accordingly, some embodiments of the silicone smokeless tobacco product enable an adult tobacco consumer to handle and use each individual preformed piece from the container without it falling apart.

A system can include a container including a lid and a base that defines an interior space. A plurality of silicone smokeless tobacco products having a substantially similar shape can be disposed in the interior space of the container. Each of the silicone smokeless tobacco products includes tobacco and a silicone binder formed into the substantially similar shape such that at least a portion of the tobacco is exposed along exterior surfaces of each of the silicone smokeless tobacco products. In other embodiments, the system can include other types of containers or packages.

In some embodiments, a method of consuming tobacco entails opening a container housing a plurality of silicone smokeless-tobacco products and placing at least one of the silicone smokeless tobacco products in the mouth of an adult tobacco consumer such that at least a portion of the tobacco contacts tissue in the adult tobacco consumer's mouth. Each silicone smokeless tobacco product in the container has a substantially similar shape. Each silicone smokeless tobacco product includes tobacco and a silicone binder formed into the substantially similar shape silicone smokeless tobacco product. In certain embodiments, at least one silicone smokeless tobacco product is placed in the mouth of the adult tobacco consumer between a gingival and a lip. The method can, in certain embodiments, include pressing at least one silicone smokeless tobacco product between the gingiva and the lip to accommodate the smokeless tobacco product within the contours of at least a portion of the gingival, the lip, or a combination thereof. In some embodiments, the silicone smokeless-tobacco product has elasticity and the method includes working the product in the mouth.

In some embodiments, a method of making a silicone smokeless tobacco product entails mixing smokeless tobacco and a silicone binder material and having the silicone-binder material cross-link. In some embodiments, the silicone-binder material is cross-linked due to the presence of water in the smokeless tobacco. A cross-linking agent (e.g., peroxide) can also be added. In some embodiments, energy can be supplied to cross-link the silicone-binder material. The silicone-binder material can be provided in solvent-based, solvent-less, and/or solid flake form. In some embodiments, the silicone-binder material and the smokeless tobacco can be mixed by a mechanical mixing tool. In other embodiments, a solvent-based silicone-binder material can be strayed onto smokeless tobacco. In some embodiments, the solvent-based silicon-binder material is sprayed into an outer surface of a plurality of shaped smokeless-tobacco bodies each having a substantially similar shape. In other embodiments, smokeless tobacco is deposed onto a conveyor as a layer and sprayed with a solvent-based silicone-binder material to form a film. Multiple alternating layers can be deposited to build up a desired thickness and shaped bodies of silicone smokeless tobacco products can be cut. A plurality of shaped smokeless tobacco bodies can be inserted into a container. The container can be closed and sealed. In some embodiments, the mixing can include adding other materials (such as flavorants) into the mixture.

The silicone binder can be a food grade silicone based polymer. The silicone binder can be a polymeric organosilicone compound. The silicone binder can be a silicone rubber or silicone elastomer. In other embodiments, the silicone binder can be a rigid silicone. In some embodiments, the silicone binder can be a polysiloxane. For example, the silicone binder can be polydimethylsiloxane (PDMS), which is available under the trade name SILASTIC and sold by the Dow Corning Corporation. Additional silicone binders, such as XIAMETER High consistency silicone rubber, are also available from the Dow Corning Corporation. In other embodiments, the silicone binder can be the silicone binders available under the trade name LOCTITE SUPERFLEX and sold by Henkel. The silicone binder can be cross-linked. The silicone binder can be cross-linked due to the presence of water. In other embodiments, an additional cross-linking agent is used to cross-link the silicone binder. In some embodiments, the silicone binder is optically clear. In other embodiments, the silicone binder can include a pigment or have a natural coloring.

The shape of the silicone smokeless tobacco product can, for example, be square or rectangular-shaped, rounded-edge rectangular-shaped, elliptical-shaped, semi-circular, football-shaped, boomerang-shaped, teardrop-shaped, comma-shaped, bowtie-shaped, or peanut-shaped. In some embodiments, the shape can have at least one pair of opposing, generally parallel exterior surfaces. A pair of opposing, generally parallel exterior surfaces can be between 3 mm and 50 mm apart. For example, the generally parallel exterior surfaces may be between 5 and 10 mm apart. In certain embodiments, the silicone smokeless tobacco body has three pairs of opposing, generally parallel exterior surfaces. For example, the shape can be a substantially rectangular cuboidal shape. The substantially rectangular cuboidal shape can have a length of between 15 mm and 50 mm, a width of between 5 mm and 20 mm, and a thickness of between 3 mm and 10 mm. In some embodiments, the shape has a length of between 18 mm and 30 mm, a width of between 8 mm and 13 mm, and/or a thickness of between 6 mm and 11 mm. In other embodiments, the silicone smokeless tobacco product includes a rod or tube attached to a silicone/smokeless tobacco body. In some embodiments, the silicone smokeless tobacco product is a stick having a silicone/smokeless tobacco coating.

The silicone smokeless-tobacco product can include at least 10 weight percent of silicone binder. The silicone smokeless-tobacco product can, in some embodiments, include less than 75 weight percent silicone binder. In certain embodiments, the silicone smokeless-tobacco product includes between 15 and 30 weight percent silicone binder.

The smokeless tobacco, in some embodiments, is moist snuff. The smokeless tobacco can have an oven volatiles content of at least 40 weight percent. In certain embodiments, the tobacco can include between 48 and 50 weight percent oven volatiles. The silicone smokeless tobacco products can, in some embodiments, have an oven volatiles content of between 50 and 61 weight percent (e.g., about 57 weight percent oven volatiles). In other embodiments, the tobacco can have a lower moisture content. For example, the total oven volatiles content for a silicone smokeless tobacco product can be between 5 and 40 weight percent. In some embodiments, the total oven volatiles content for a silicone smokeless tobacco product is between 15 and 30 weight percent.

In certain embodiments, the tobacco is long-cut tobacco. The tobacco can be fermented or non-fermented tobacco in fine cut or shredded leaf form. For example, long cut smokeless tobacco typically is cut or shredded into widths of about 10 cuts/inch up to about 110 cuts/inch and lengths of about 0.1 inches up to about 1 inch. Double cut smokeless tobacco can have a range of particle sizes such that about 70% of the double cut smokeless tobacco falls between the mesh sizes of −20 mesh and 80 mesh. Both long cut smokeless tobacco and double cut smokeless tobacco can be used as the tobacco in the silicone smokeless tobacco product. The tobacco can also be cured (e.g., air cured, fire cured, flue cured, etc.). The tobacco can include tobacco prepared from plants having less than 20 μg of DVT per $cm^2$ of green leaf tissue.

The one or more silicone smokeless tobacco products can include a flavorant. For example, the silicone smokeless tobacco product can include one or more of the following flavorants: licorice, wintergreen, cherry and berry type flavorants, Drambuie, bourbon, scotch, whiskey, spearmint, peppermint, lavender, cinnamon, cardamon, *Apium graveolens*, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang-ylang, sage, fennel, piment, ginger, anise, coriander, coffee, and mint oils from a species of the genus Mentha. In certain embodiments, the silicone smokeless tobacco products consist essentially of the tobacco, the silicone binder, and optionally one or more flavorants, sweeteners, fillers, water, salt, and/or pH adjusters.

According to certain other embodiments, a silicone oral product includes a silicone binder, cellulose fibers, and nicotine absorbed in the cellulose fibers. The silicone binder can secure the cellulose fibers and the nicotine can be released from the cellulose fibers when the silicone oral product is placed in an adult consumer's mouth. The cellulose fibers can be non-tobacco fibers, such as sugar beet fibers. The nicotine can be synthetic or derived from tobacco.

The details of one or more embodiments are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
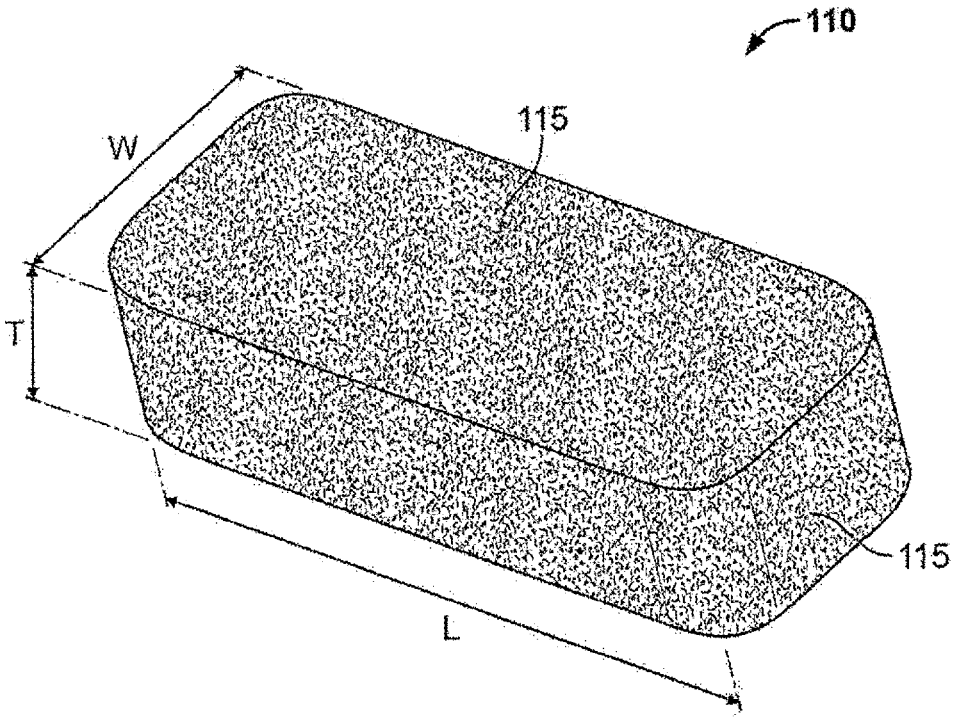
FIG. 1 depicts a perspective view of an embodiment of a silicone-smokeless-tobacco product with a predetermined shape.
Figure 2:
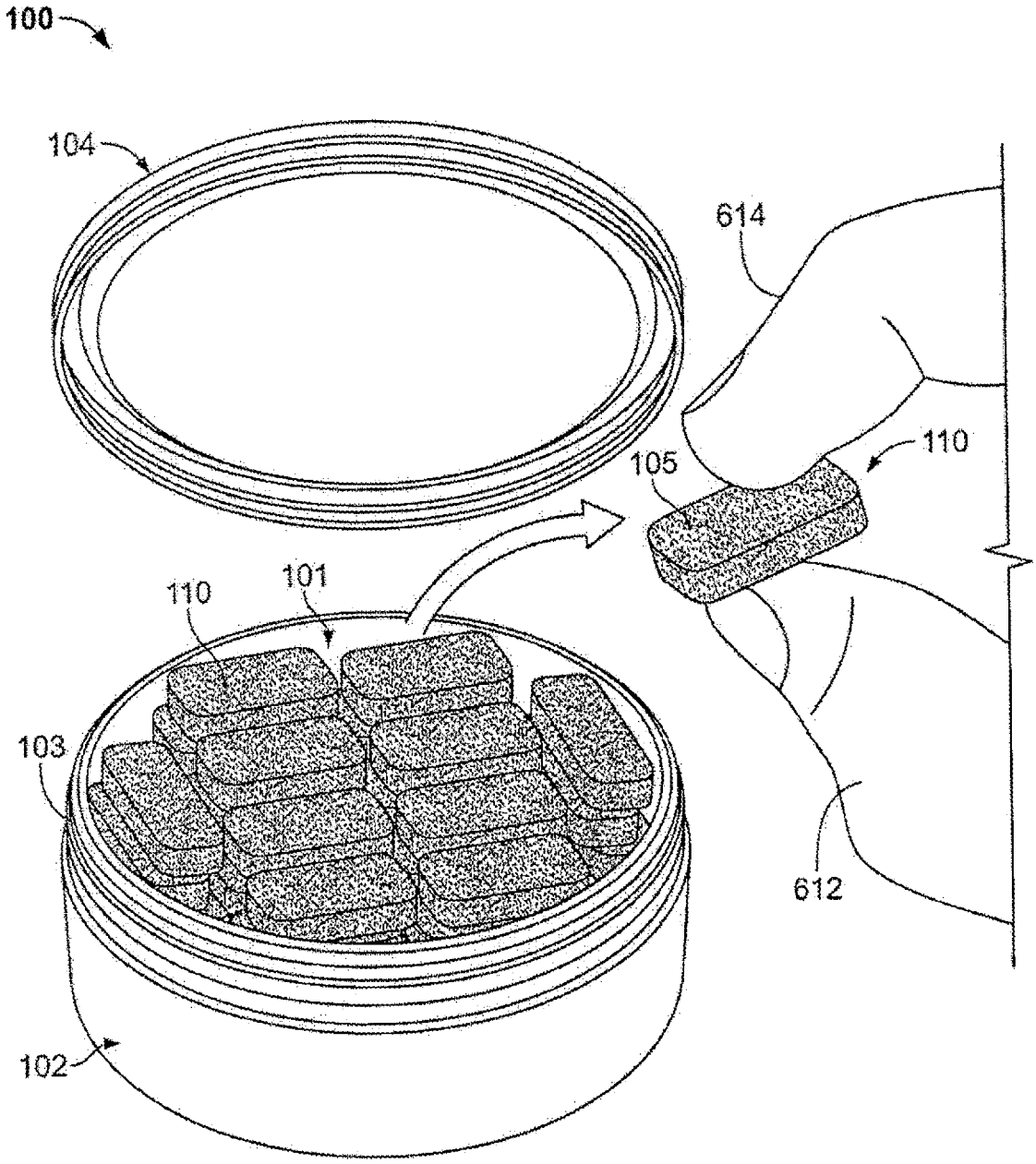
FIG. 2 depicts a substantially cylindrical container retaining a plurality of silicone smokeless tobacco products, each with a substantially similar shape.

Referring to FIGS. 1-2, some embodiments of a smokeless tobacco system 100 can include one or more silicone smokeless tobacco products 110 arranged in an interior space 101 of a container 102 that mates with a lid 104. Some embodiments of the silicone smokeless tobacco product 110 can include a smokeless tobacco 115 combined with one or more silicone binders. The smokeless tobacco 115 and the one or more silicone binders are combined and shaped into an adult tobacco consumer convenient shape prior to packaging so that a predetermined portion of the smokeless tobacco 115 is retained by the shaped product 110 yet still exposed on an exterior surface of the shaped product 110. As described in more detail below, the depicted embodiment of the smokeless tobacco product 110 can comprise a moist smokeless tobacco.

As described in more detail below, the silicone smokeless tobacco product 110 described herein may have a beneficial combination of material properties that enhance tobacco satisfaction with improved tactile and flavor benefits. For example, the silicone smokeless tobacco product 110 retains its shape during processing, shipping, and adult tobacco consumer handling, thus permitting an adult tobacco consumer to handle an individual silicone smokeless tobacco product without it falling apart. Accordingly, the system 100 enables an adult tobacco consumer to receive consistent portions of tobacco (e.g., with each selected product 110 in the mouth) while also experiencing the tactile and flavor benefits of having the smokeless tobacco externally exposed on the article (e.g., not retained inside a paper-like pouch or sachet). Additionally, in some embodiments, the silicone binder employed in the silicone smokeless-tobacco product 110 can enhance the release and/or duration of flavors. For example, the silicone binder can be hydrophobic, which can improve the flavor profile of the silicone smokeless tobacco product. The product can also be elastic and can be worked in the mouth. This unique combination of handling properties, mouth feel, and flavor release can enhance tobacco satisfaction with improved tactile and flavor benefits.

Figure 4A:
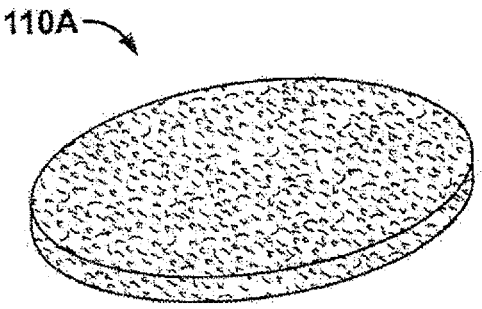
FIGS. 4A-4N depict alternative shapes for the silicone smokeless tobacco product.
Figure 4B:
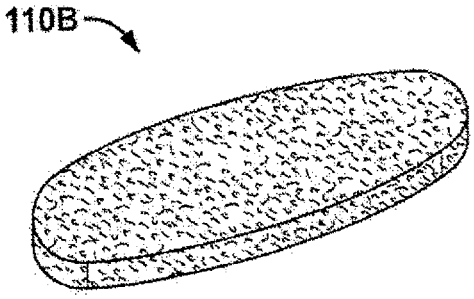
Figure 4C:
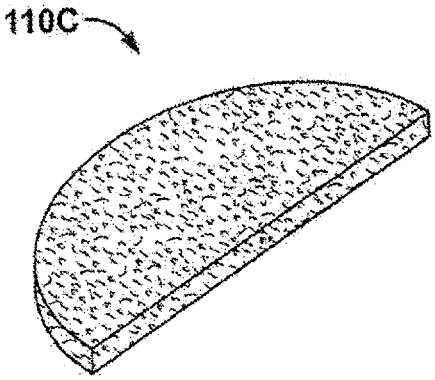
Figure 4D:
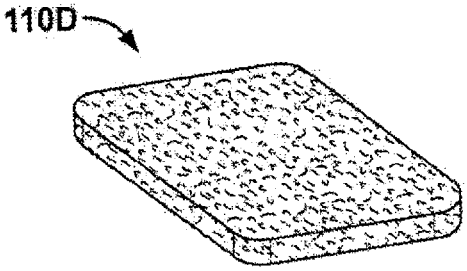
Figure 4E:
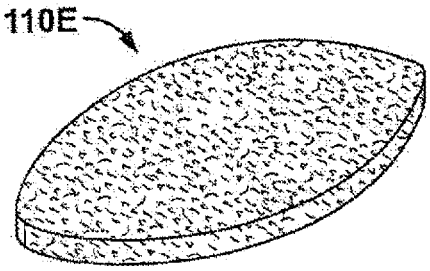
Figure 4F:
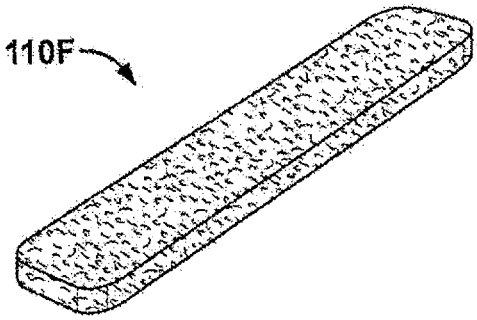
Figure 4G:
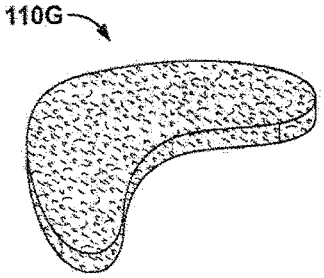
Figure 4H:
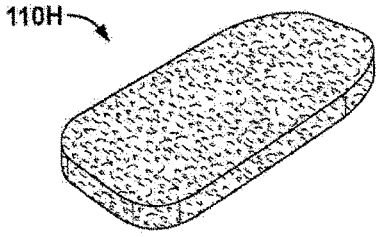
Figure 4I:
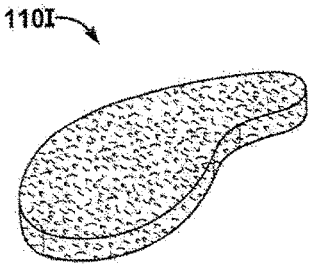
Figure 4J:
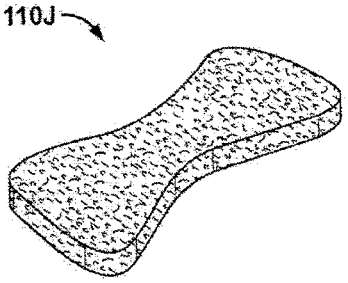
Figure 4K:
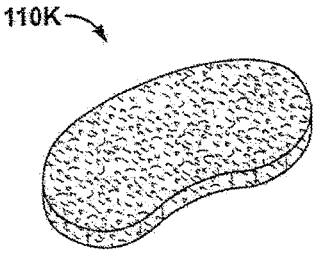
Figure 4L:
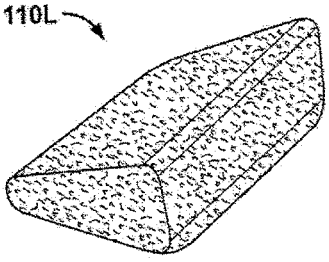
Figure 4M:
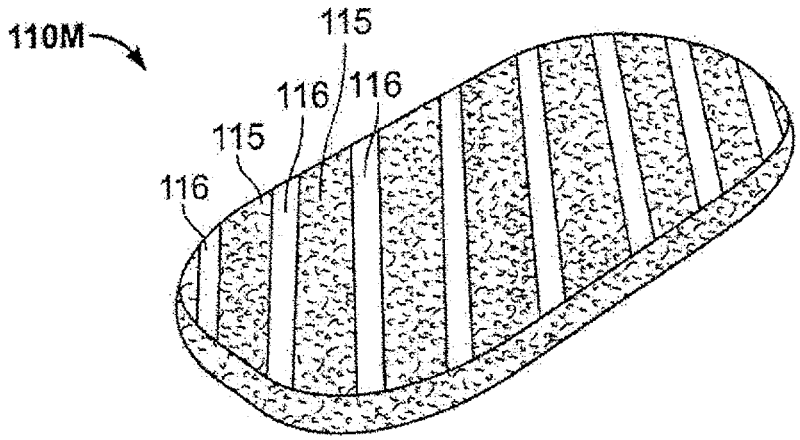
Figure 4N:
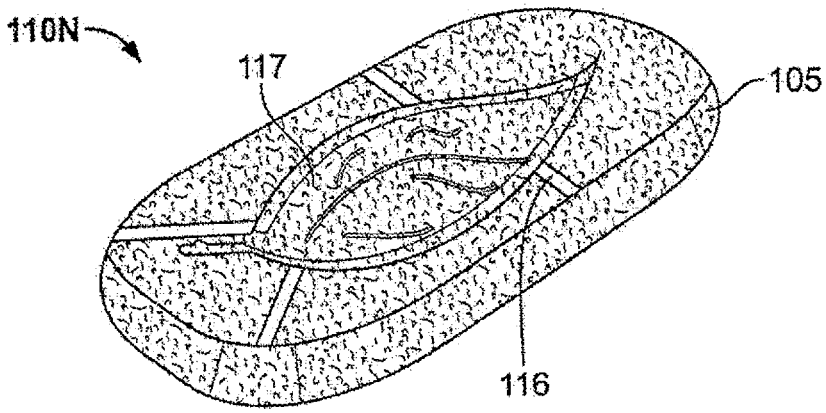
Figure 5A:
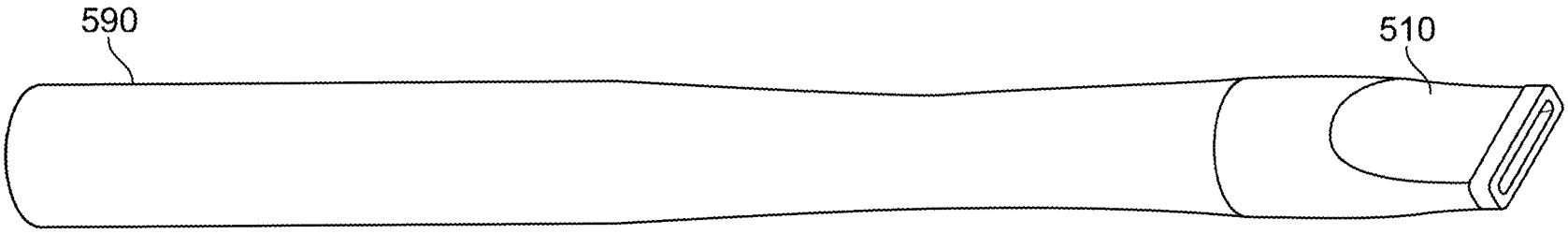
FIGS. 5A-5H depict silicone-smokeless tobacco rods and coated sticks.
Figure 5B:
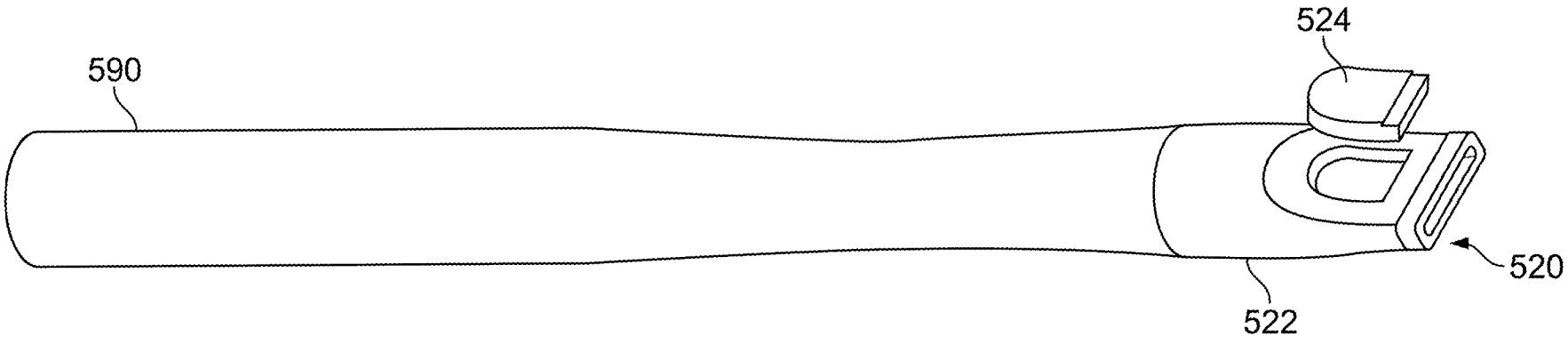
Figure 5C:
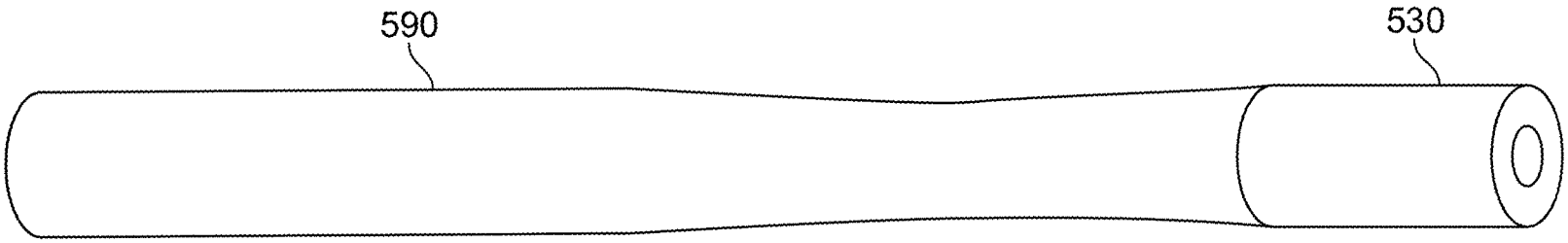
Figure 5F:
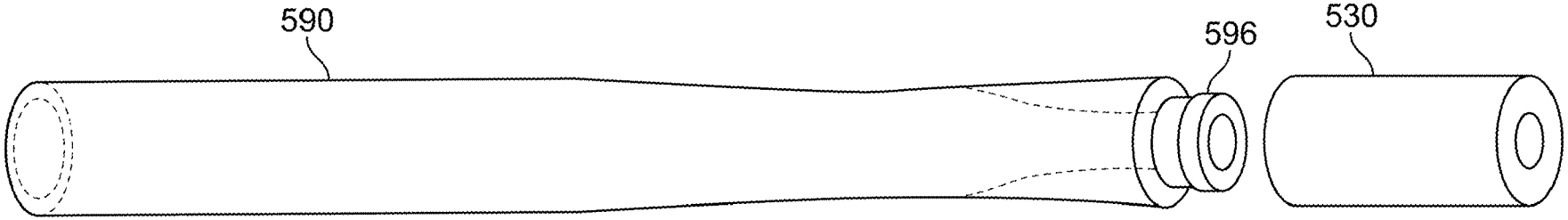
Figure 5D:
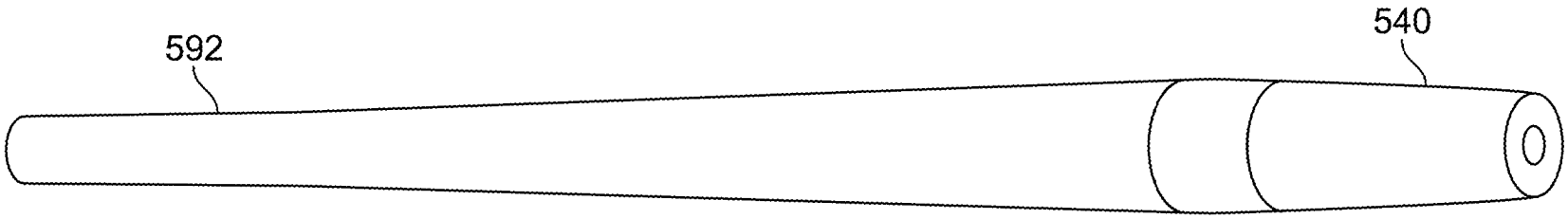
Figure 5E:
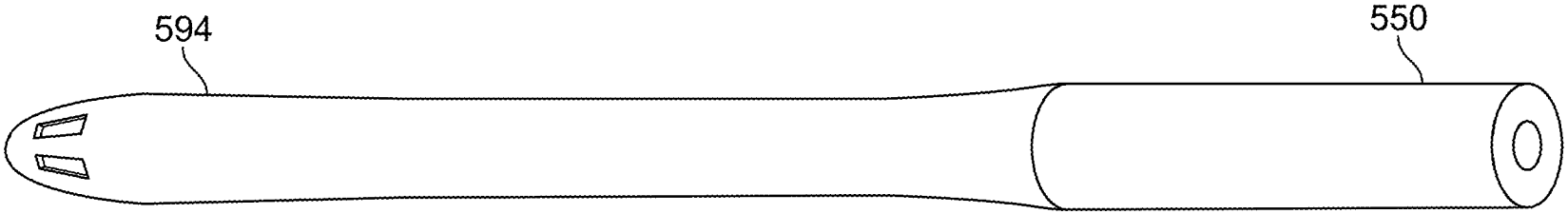
Figure 5G:
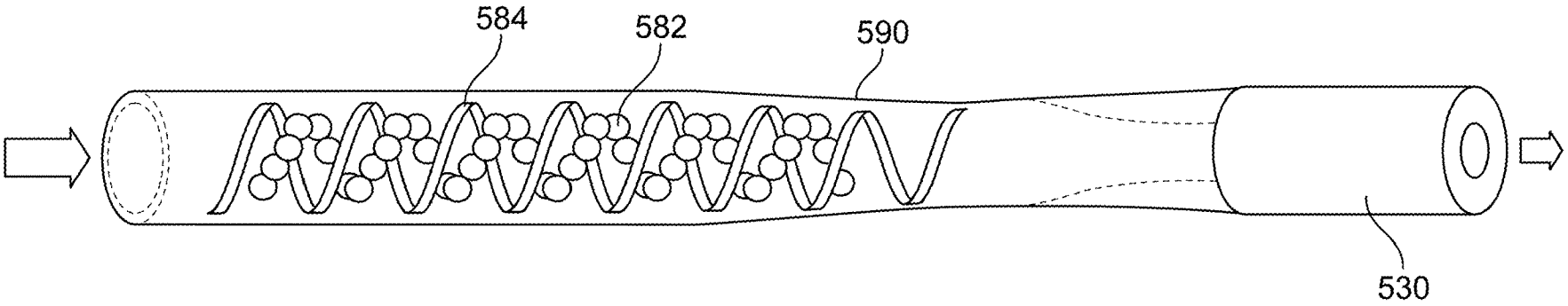
Figure 5H:
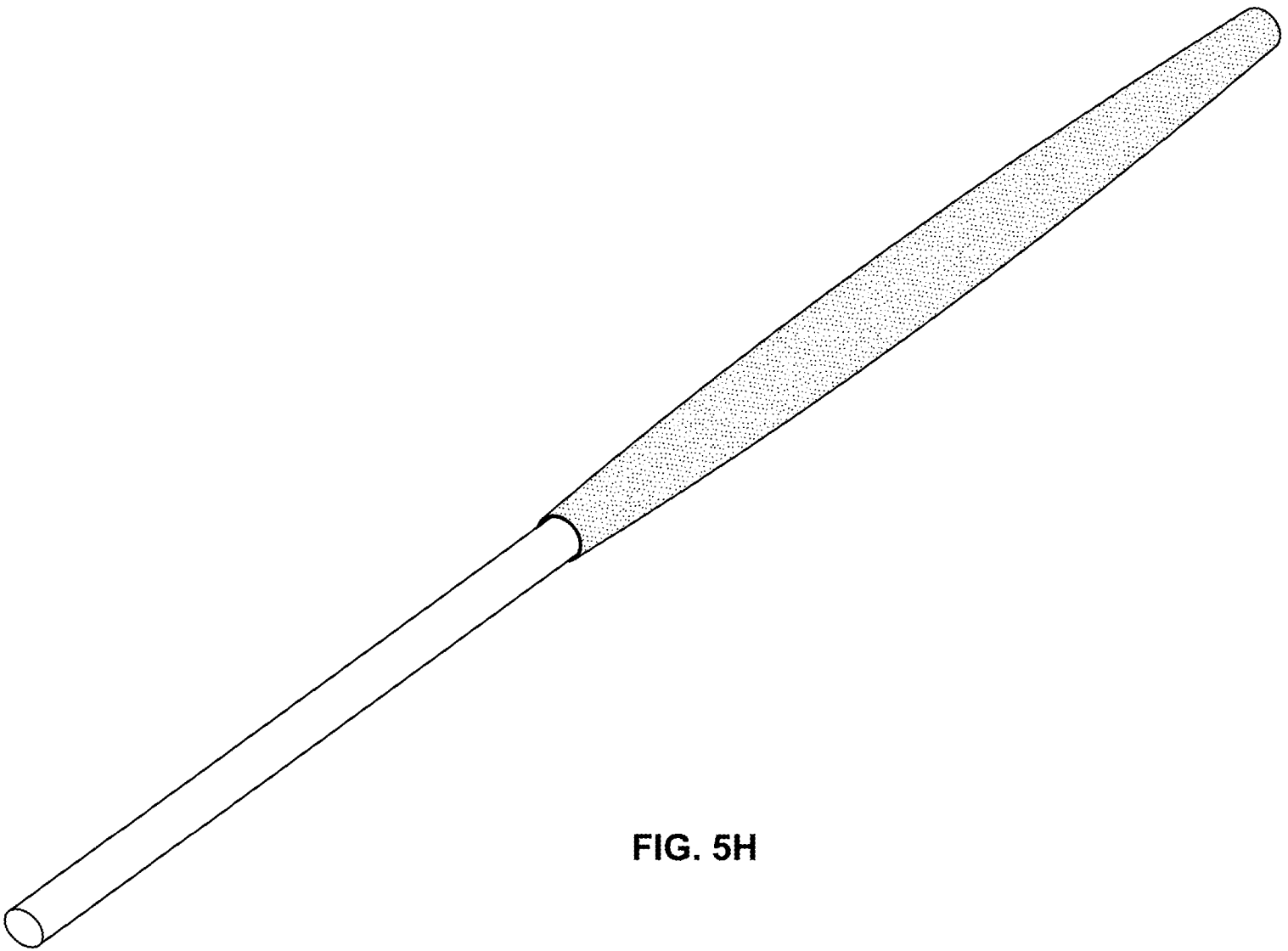

Referring to FIG. 1, each of the silicone smokeless tobacco products 110 can be molded into a selected shape that is beneficial for placement in an adult tobacco consumer's mouth while also exposing the tobacco 115 along one or more exterior surfaces when the product 110 is inserted in the adult tobacco consumer. Different embodiments of the silicone smokeless tobacco product can have a variety of different specific combinations of ingredients. The silicone smokeless tobacco product can also have a variety of shapes and dimensions. For example, FIG. 1 depicts an embodiment of a silicone smokeless tobacco product 110 having a substantially rectangular cuboidal shape in which the corners are rounded in a longitudinal plane. As such, as shown in FIG. 2, each of the silicone smokeless tobacco products 110 have a substantially similar shape. The shape can include at least one pair of opposing, generally parallel exterior surfaces, and as shown in the depicted embodiment, can include three pairs of opposing, generally parallel exterior surfaces. Other possible predetermined shapes are shown in FIGS. 4A-4N (described in more detail below). The silicone smokeless tobacco products can also be combined with other devices. For example, a tube or rod can be attached to a silicone/smokeless tobacco tip, as shown in FIGS. 5A-5G. In other embodiments, a stick can have a silicone/smokeless tobacco coating as shown in FIG. 5H.

The preformed smokeless tobacco can be formed into the selected shape by mixing the smokeless tobacco 115 and at least one silicone binder into the desired product shape. In some embodiments, the silicone-binder material (e.g., a solventless silicone binder material) can be mixed with a mechanical mixing tool (e.g., a spoon or food processing equipment). The mixture can be formed into a desired shape using a mold. In some embodiments, the mixture can be loosely packed within the mold. In other embodiments, a silicone binder material (e.g., a solvent-based silicone-binder material) can be sprayed into smokeless tobacco (e.g., in a shaped body or deposited as a layer). The silicone-binder material is cross-linked/cured during or after the mixing of the smokeless tobacco with the silicone binder material. In some embodiments, the silicone-binder material is cross-linked/cured by the water in the smokeless-tobacco. In other embodiments, cross-linking/curing agents (e.g., peroxide) or energy (e.g., heat) or catalyst can be used to cross-link/cure the silicone-binder material. In some embodiments, a metal catalyst (e.g., platinum) can be added to cure the silicone-binder material. If a solvent-based silicone-binder material is used, the method can include various processes to remove the solvent. After shaping, a plurality of silicone smokeless tobacco products 110, each having a substantially similar shape, can be packaged together in the container 102 of the system 100 such that the interior space 101 is sealed at least in part by the lid 104.

I. Product Constituents

The silicone smokeless tobacco product 110 includes tobacco and a silicone binder. The product 110 can optionally include one or more flavorants and other additives. The particular composition may, in part, determine the material properties of the silicone smokeless tobacco product 110.

Tobacco

Smokeless tobacco is tobacco suitable for use in an orally used tobacco product. By "smokeless tobacco" it is meant a part, e.g., leaves, and stems, of a member of the genus *Nicotiana* that has been processed. Exemplary species of tobacco include *N. rustica, N. tabacum, N. tomentosiformis*, and *N. sylvestris*. Suitable tobaccos include fermented and unfermented tobaccos, dark air-cured, dark fire cured, burley, flue cured, and cigar filler or wrapper, as well as the products from the whole leaf stemming operation. In some embodiments, smokeless tobacco includes up to 70% dark tobacco on a fresh weight basis. For example, tobacco can be conditioned by heating, sweating and/or pasteurizing steps as described in U.S. Publication Nos. 2004/0118422 or 2005/0178398. Fermenting typically is characterized by high initial moisture content, heat generation, and a 10 to 20% loss of dry weight. See, e.g., U.S. Pat. Nos. 4,528,993; 4,660,577; 4,848,373; and 5,372,149. In addition to modifying the aroma of the leaf, fermentation can change either or both the color and texture of a leaf. Also during the fermentation process, evolution gases can be produced, oxygen can be taken up, the pH can change, and the amount of water retained can change. See, for example, U.S. Publication No. 2005/0178398 and Tso (1999, Chapter 1 in Tobacco, Production, Chemistry and Technology, Davis & Nielsen, eds., Blackwell Publishing, Oxford). Cured, or cured and fermented tobacco can be further processed (e.g., cut, expanded, blended, milled or comminuted) prior to incorporation into a silicone smokeless tobacco product. The tobacco, in some embodiments, is long cut fermented cured moist tobacco having an oven volatiles content of between 48 and 50 weight percent prior to mixing with the silicone binder and optionally flavorants and other additives.

The tobacco can, in some embodiments, be prepared from plants having less than 20 μg of DVT per $cm^2$ of green leaf tissue. For example, the tobacco particles can be selected from the tobaccos described in U.S. Patent Publication No. 2008/0209586, which is hereby incorporated by reference. Tobacco compositions containing tobacco from such low-DVT varieties exhibits improved flavor characteristics in sensory panel evaluations when compared to tobacco or tobacco compositions that do not have reduced levels of DVTs.

Green leaf tobacco can be cured using conventional means, e.g., flue-cured, barn-cured, fire-cured, air-cured or sun-cured. See, for example, Tso (1999, Chapter 1 in Tobacco, Production, Chemistry and Technology, Davis & Nielsen, eds., Blackwell Publishing, Oxford) for a description of different types of curing methods. Cured tobacco is usually aged in a wooden drum (i.e., a hogshead) or cardboard cartons in compressed conditions for several years (e.g., two to five years), at a moisture content ranging from 10% to about 25%. See, U.S. Pat. Nos. 4,516,590 and 5,372,149. Cured and aged tobacco then can be further processed. Further processing includes conditioning the tobacco under vacuum with or without the introduction of steam at various temperatures, pasteurization, and fermentation. Fermentation typically is characterized by high initial moisture content, heat generation, and a 10 to 20% loss of dry weight. See, e.g., U.S. Pat. Nos. 4,528,993, 4,660,577, 4,848,373, 5,372,149; U.S. Publication No. 2005/0178398; and Tso (1999, Chapter 1 in Tobacco, Production, Chemistry and Technology, Davis & Nielsen, eds., Blackwell Publishing, Oxford). Cure, aged, and fermented smokeless tobacco can be further processed (e.g., cut, shredded, expanded, or blended). See, for example, U.S. Pat. Nos. 4,528,993; 4,660,577; and 4,987,907.

The smokeless tobacco can be processed to a desired size. For example, long cut smokeless tobacco typically is cut or shredded into widths of about 10 cuts/inch up to about 110 cuts/inch and lengths of about 0.1 inches up to about 1 inch. Double cut smokeless tobacco can have a range of particle sizes such that about 70% of the double cut smokeless tobacco falls between the mesh sizes of −20 mesh and 80 mesh. Other lengths and size distributions are also contemplated. In some embodiments, the tobacco can be powdered (e.g., having an average particle size of about 40 microns).

The smokeless tobacco can have a total oven volatiles content of about 10% by weight or greater; about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight. Those of skill in the art will appreciate that "moist" smokeless tobacco typically refers to tobacco that has an oven volatiles content of between about 40% by weight and about 60% by weight (e.g., about 45% by weight to about 55% by weight, or about 50% by weight). As used herein, "oven volatiles" are determined by calculating the percentage of weight loss for a sample after drying the sample in a pre-warmed forced draft oven at 110° C. for 3.25 hours. The silicone smokeless tobacco product can have a different overall oven volatiles content than the oven volatiles content of the smokeless tobacco used to make the silicone smokeless tobacco product. The processing steps described herein can reduce or increase the oven volatiles content.

The silicone smokeless tobacco product can include between 15 weight percent and 85 weight percent smokeless tobacco on a dry weight basis. The amount of smokeless tobacco on a dry weight basis is calculated after drying the silicone smokeless tobacco product in a pre-warmed forced draft oven at 110° C. for 3.25 hours. The remaining non-volatile material is then separated into tobacco material and silicone material. The percent smokeless tobacco in the silicone smokeless tobacco product is calculated as the weight smokeless tobacco divided by the total weight of the non-volatile materials. In some embodiments, the silicone smokeless tobacco product includes between 20 and 60 weight percent tobacco on a dry weight basis. In some embodiments, the silicone smokeless tobacco product includes at least 25 weight percent tobacco on a dry weight basis. For example, a silicone smokeless tobacco product can include a total oven volatiles content of about 44 weight percent, about 23 weight percent silicone binder, and about 33 weight percent smokeless tobacco on a dry weight basis.

In other embodiments, as an alternative to tobacco, the silicone product can include cellulose fibers and nicotine absorbed in the cellulose fibers. The cellulose fibers can be non-tobacco cellulose fibers. For example, cellulose fibers can be sugar beet fibers. In some embodiments, the cellulose fibers are fibers obtained from SOLKA-FLOC. The nicotine can be tobacco-derived nicotine, synthetic nicotine, or a combination thereof. Tobacco-derived nicotine can include one or more tobacco organoleptic components other than nicotine. The oral silicone product can include a combination of nicotine, sweeteners, and flavorants to mimic the flavor profile and tactile experience of certain tobacco products. In some embodiments, an oral silicone product including nicotine, but is substantially free of tobacco.

Silicone Binder

Silicone binders suitable for use in the silicone smokeless tobacco product described herein can be a food grade silicone based polymer. The silicone binder can be a silicone rubber. In other embodiments, the silicone binder can be a rigid silicone.

The silicone binder can be a food grade silicone based polymer. The silicone binder can be a polymeric organosilicone compound. The silicone binder can be a silicone rubber or silicone elastomer. In other embodiments, the silicone binder can be a rigid silicone. In some embodiments, the silicone binder can be a polysiloxane. For example, the silicone binder can be polydimethylsiloxane (PDMS), which is available under the trade name SILASTIC and sold by the Dow Corning Corporation. In other embodiments, the silicone binder can be the silicone binders available under the trade name LOCTITE SUPERFLEX and sold by Henkel. The silicone binder can be cross-linked. The silicone binder can be cross-linked due to the presence of water. In other embodiments, an additional cross-linking agent is used to cross-link the silicone binder. In some embodiments, the silicone binder is optically clear. In other embodiments, the silicone binder can include a pigment or have a natural coloring.

The silicone binder can be present in amounts that allow the silicone smokeless tobacco product 110 to have desired material properties. The specific amount of silicone binder used to achieve the particular material properties can depend, in part, on the type of silicone binder used. In some embodiments, the silicone smokeless tobacco product 110 includes at least 10 weight percent silicone binder, which can increase the likelihood that the silicone smokeless tobacco product 110 maintains its integrity during packaging and transport. In certain embodiments, the silicone smokeless tobacco product 110 has at least 12 weight percent silicone, at least 15 weight percent silicone, at least 20 weight percent silicone, or at least 25 weight percent silicone. The silicone smokeless tobacco product 110 has, in some embodiments, less than 75 weight percent silicone binder. In certain embodiments, the silicone smokeless tobacco product 110 has less than 60 weight percent silicone, less than 50 weight percent silicone, less than 40 weight percent silicone, less than 30 weight percent silicone, or less than 25 weight percent silicone. In some embodiments, the silicone binder of each silicone smokeless tobacco product 110 is between 15 and 30 weight percent of the silicone smokeless tobacco product.

Flavorants and Other Components

In some embodiments, the silicone smokeless tobacco product 110 can optionally include one or more flavorants. For example, suitable flavorants include wintergreen, cherry and berry type flavorants, various liqueurs and liquors (such as Drambuie, bourbon, scotch, and whiskey), spearmint, peppermint, lavender, cinnamon, cardamon, *Apium graveolens*, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang-ylang, sage, fennel, piment, ginger, anise, coriander, coffee, liquorish, and mint oils from a species of the genus Mentha. Mint oils useful in particular embodiments of the silicone smokeless tobacco product 110 include spearmint and peppermint.

The silicone smokeless tobacco product 110 may optionally include other additives. Other additives include fillers (e.g., starch, di-calcium phosphate, lactose, sorbitol, mannitol, and microcrystalline cellulose), soluble fiber (e.g., Fibersol from Matsushita), calcium carbonate, dicalcium phosphate, calcium sulfate, and clays), lubricants (e.g., lecithin, stearic acid, hydrogenated vegetable oil, mineral oil, polyethylene glycol 4000-6000 (PEG), sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides), plasticizers (e.g., glycerine, propylene glycol, polyethylene glycol, sorbitol, mannitol, triacetin, and 1,3 butane diol), stabilizers (e.g., ascorbic acid and monosterol citrate, BHT, or BHA), artificial sweeteners (e.g., sucralose, saccharin, and aspartame), disintegrating agents (e.g., starch, sodium starch glycolate, cross caramellose, cross linked PVP), pH stabilizers, or other compounds (e.g., vegetable oils, surfactants, and preservatives). Some compounds display functional attributes that fall into more than one of these categories. For example, propylene glycol can act as both a plasticizer and a lubricant and sorbitol can act as both a filler and a plasticizer. Water and other oven volatiles can also be added during a mixing process (discussed below) to alter the total oven volatiles content of the formed smokeless tobacco product 110. Various salts can also be added.

The type and amount of flavorants and other additives can also impact the material properties of the silicone smokeless tobacco product. In some embodiments, the amount of flavorants and other additives in the silicone smokeless tobacco product 110 are limited to less than 10 weight percent in sum. In some embodiments, the amount of flavorants in the silicone smokeless tobacco product 110 are limited to be less than 5 weight percent in sum. For example, certain flavorants can be included in the silicone smokeless tobacco product 110 in amounts of about 3 weight percent.

In some embodiments, the combination of tobacco, flavorants, and other additives used in the silicone smokeless tobacco product 110 can be the mixture of tobacco, flavorants, and other additives commercially sold as smokeless tobacco. For example, the finished tobacco can be the same as the finished smokeless tobacco sold under the trade name SKOAL (e.g., SKOAL Long Cut), which includes flavorants and other additives.

Oven Volatiles

Some embodiments of the silicone smokeless tobacco product 110 can have a total oven volatiles content of between 5 and 61 weight percent. The oven volatiles include water and other volatile compounds, which can be a part of the tobacco, the silicone binder, the flavorants, and/or other additives. As used herein, the "oven volatiles" are determined by calculating the percentage of weight loss for a sample after drying the sample in a pre-warmed forced draft oven at 110° C. for 3.25 hours. The silicone binder may absorb some of the oven volatiles during the mixing process and forming process. In some embodiments, the oven volatiles content of the silicone smokeless tobacco product 110 is between 40 and 61 weight percent. For example, the oven volatiles content of each silicone smokeless tobacco product 110 can be about 43-50 weight percent. In other embodiments, the oven volatiles content can be between 10 and 40 weight percent. In certain embodiments, the oven volatiles content is between 15 and 30 weight percent.

III. Making & Packing

A method of making a silicone smokeless tobacco product entails mixing smokeless tobacco and one or more silicone-binder components into a mixture and forming at least a portion of the mixture into a shaped smokeless tobacco body and having the one or more silicone-binder components cross-link. In some embodiments, the one or more silicone-binder components become cross-linked due to the presence of water in the smokeless tobacco. A cross-linking agent (e.g., peroxide) can also be added. In some embodiments, energy can be supplied to cross-link the one or more silicone-binder components. The shaped smokeless tobacco body can have at least a portion of the tobacco exposed along an exterior surface of the shaped smokeless tobacco body. The one or more silicone-binder components can be provided in solvent-based, solventless, and/or solid flake form.

Some embodiments of the method of making the silicone smokeless tobacco product 110 can include mixing the tobacco, the one or more silicone-binder components, and any flavorants or other additives and shaping the mixture into the predetermined shape. In some embodiments, the one or more silicone-binder components and the smokeless tobacco can be mixed by a mechanical mixing tool. In other embodiments, solvent-based silicone-binder components can be sprayed onto smokeless tobacco. In some embodiments, solvent-based silicone-binder components are sprayed into an outer surface of a plurality of shaped smokeless tobacco bodies each having a substantially similar shape and each having at least a portion of the tobacco exposed along an exterior surface. In other embodiments, smokeless tobacco is deposed onto a conveyor as a layer and sprayed with solvent-based silicone-binder components to form a film. Multiple alternating layers can be deposited to build up a desired thickness and shaped bodies of silicone smokeless tobacco products can be cut. A plurality of shaped silicone smokeless tobacco bodies can be inserted into a container. The container can be closed and sealed. In some embodiments, the blending mixing can include adding other materials (such as flavorants) into the mixture.

Figure 3:
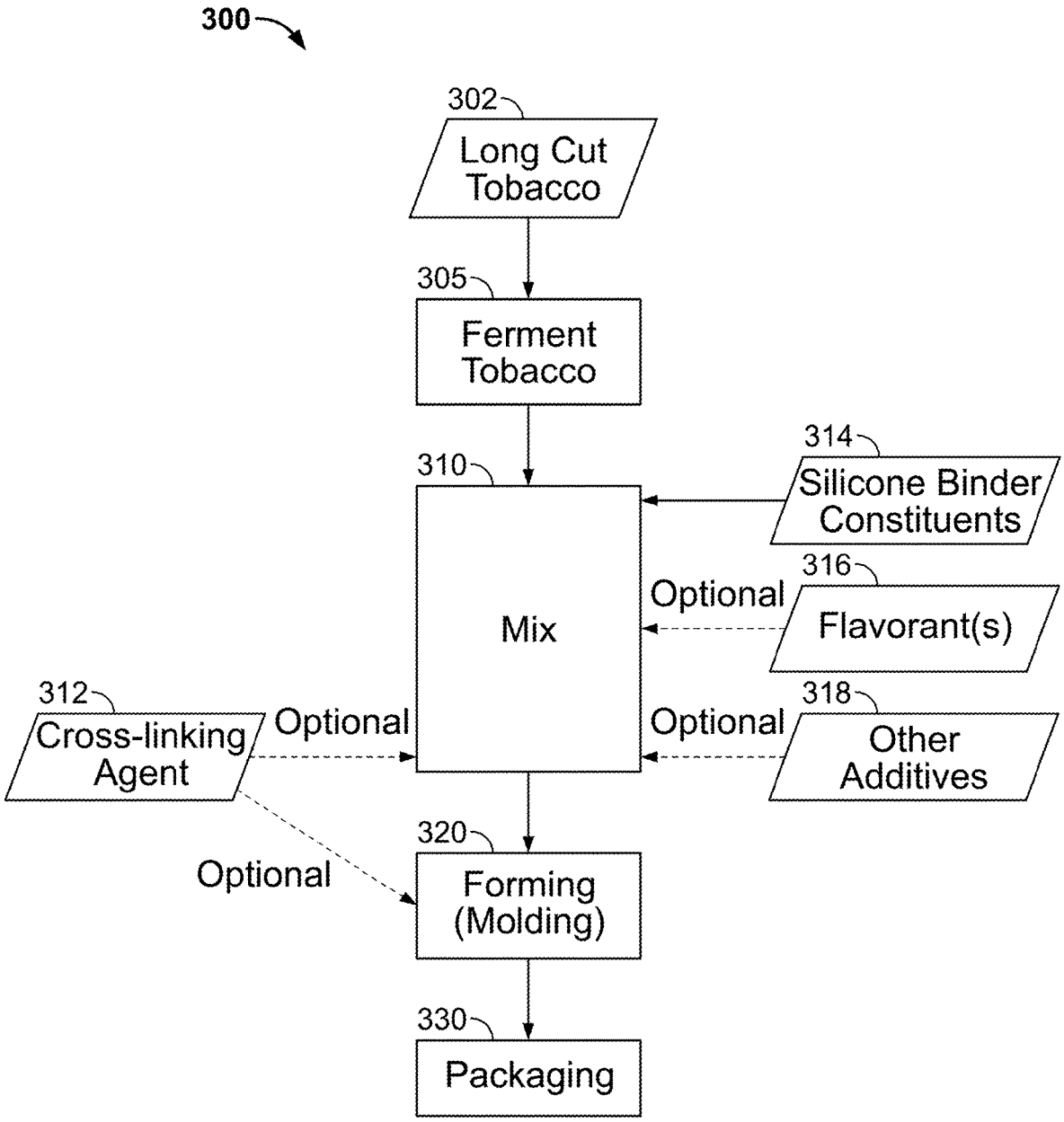
FIG. 3 is a flow chart showing an exemplary method of forming shaped smokeless tobacco bodies.

FIG. 3 is a flow chart 300 showing an example of how the silicone smokeless tobacco product can be made and packaged. In some embodiments, the tobacco can be cured long cut tobacco. Tobacco 302 can be fermented in step 305 and added to a mixer. In some embodiments, a cross-linking agent 312 (e.g., a peroxide) is added to the mixer. One or more silicone-binder constituents 314, and optionally flavorants 316 and/or other additives 318 are mixed with the tobacco 302 in mixing step 310. For example, tobacco 302 can be long cut tobacco having an oven volatiles content of 48-50 weight percent. The silicone-binder constituents 314 can be polysiloxane. The flavorants 316 and other additives 318 can include, for example, a mint flavoring, a sweetener, and a pH modifier. The mixing step 310 can occur in any commercially available countertop mixer or industrial mixer, for example a HOBART 40 lbs mixer or a FORBERG 250 lbs Paddle Mixer. Water can be added to the tobacco prior to or during the mixing process to alter the total oven volatiles content of the final silicone smokeless tobacco product and/or to cross-link the silicone-binder constituents. The oven volatiles content can also be modified by heating the mixture. In other embodiments, a commercially available smokeless tobacco product (e.g., SKOAL Long Cut) can be mixed with a silicone binder to form the mixture.

The forming step 320 can include depositing the mixture into a mold. In some embodiments, the mixture is deposited into an open mold plate including a plurality of identically shaped cavities. The mixture can be deposited before the silicone-binder components fully cross-link. In some embodiments, the forming step 320 can include applying energy to the mixture to cross-link the silicone-binder constituents. The forming step 320 can include applying pressure to the mixture. In some embodiments, the mold cavities have shapes corresponding to the preformed product shapes 110 shown in FIGS. 1, and 4A-4N. In some embodiments, the mold cavities have a volume sized to create formed shaped smokeless tobacco bodies 110 having a mass of about 2.35 grams. The edges and corners of the mold can be rounded to permit the formed shaped smokeless tobacco body to be easily released from the mold.

The packaging step 330 includes separating the formed shaped smokeless tobacco bodies 110 from the mold cavity and depositing the formed shaped smokeless tobacco bodies into a container 102. For example, mold plates can be separated and the formed shaped smokeless tobacco bodies can be deposited either directly into a bottom portion of a container 102 or on to an indexing conveyor. An indexing conveyor can be used to eliminate shaped smokeless tobacco bodies that do not conform to quality control standards before the remaining products are placed in the container 102.

After being placed in the interior space 103 of container 102, a lid 104 is mated with the connection rim 103 of the container 102. A label can be applied to the closed container system 100 (e.g., applied to the outer cylindrical sidewalls of the container 102 and the lid 104). Shrink wrap can also be applied to the closed container system 100. A plurality of filled, labeled, and shrink wrapped container systems 100 can then be placed in a box and shipped to a retail location.

VI. Packages and Shapes

As previously described, the silicone smokeless tobacco product can be molded into a predetermined shape prior to packaging the products 110 within the container 102. For the embodiment depicted in FIG. 1, the term "length" refers to the longest dimension L of the silicone smokeless tobacco product 110, the term "thickness" refers to the shortest dimension T of the silicone smokeless tobacco product 110, and the term "width" refers to the dimension W generally perpendicular to both the length and the thickness. As previously described, FIG. 1 depicts a perspective view of the silicone smokeless tobacco product 110 having a substantially rectangular cuboidal shape with rounded corners in the longitudinal (lengthwise) plane. In some embodiments, the silicone smokeless tobacco product has a substantially rectangular cuboidal shape having a length L of between 15 mm and 50 mm, a width W of between 5 mm and 20 mm, and a thickness T of between 3 mm and 10 mm. For example, a substantially rectangular cuboidal shape could have a length L of between 26 mm and 30 mm, a width W of between 10 mm and 12 mm, and a thickness T of between 6 mm and 8 mm. A product having a length of 28 mm, a width of 11 mm, and thickness of 7 mm could have a product weight of about 2.35 g. In other embodiments, a substantially rectangular cuboidal shape could have a length L of between 18 and 21 mm, a width W of between 10 mm and 12 mm, and a thickness T of between 9 mm and 11 mm. In other embodiments, the silicone smokeless tobacco product 110 can be cube shaped.

Referring now to FIGS. 4A-4N, the silicone smokeless tobacco product 110 can be molded into any shape that would be desirable for smokeless tobacco users. For example, referring to FIGS. 4A-4K, the silicone smokeless tobacco product 110A-K can be formed in a shape that promotes improved oral positioning for the adult tobacco consumer, improved packaging characteristic, or both. In some circumstances, the silicone smokeless tobacco product 110A-K can be configured to be: (A) an elliptical-shaped silicone smokeless tobacco product 110A; (B) an elongated elliptical-shaped silicone smokeless tobacco product 110B; (C) semi-circular silicone smokeless tobacco product 110C; (D) square or rectangular-shaped silicone smokeless tobacco product 110D; (E) football-shaped silicone smokeless tobacco product 110E; (F) elongated rectangular-shaped silicone smokeless tobacco product 110F; (G) boomerang-shaped silicone smokeless tobacco product 110G; (H) rounded-edge rectangular-shaped silicone smokeless tobacco product 110H; (I) teardrop- or comma-shaped silicone smokeless tobacco product 110I; (J) bowtie-shaped silicone smokeless tobacco product 110J; and (K) peanut-shaped silicone smokeless tobacco product 110K. Alternatively, the silicone smokeless tobacco product can have different thicknesses or dimensionality, such that a beveled article (e.g., a wedge) is produced (see, for example, product 110L depicted in FIG. 4L) or a hemi-spherical shape is produced.

In addition or in the alternative to the flavor agents previously described, flavors can be included at many different places in the process. For example, referring to FIG. 4M, for example, some embodiments of a silicone smokeless tobacco product 110M can be equipped with flavors, in the form of flavor strips 116. The flavor strips 116 can be layered within the tobacco 115 such that both the tobacco 115 and the flavor strips 116 are exposed along exterior surfaces of the product 110M.

Referring to FIG. 4N, particular embodiments of the silicone smokeless tobacco product can be embossed or stamped with a design (e.g., a logo, an image, or the like). For example, the silicone smokeless tobacco product 110N can be embossed or stamped with any type of design 117 including, but not limited to, a trademark, a product name, or any type of image. The design 117 can be formed directly into the tobacco 105, arranged along the exterior of the product 110N. The design 117 can also be embossed or stamped into those embodiments with a dissolvable film 116 applied thereto.

Similar to previously described embodiments, the silicone smokeless tobacco product 110A-N depicted in FIGS. 4A-4N can be configured to include a predetermined portion of tobacco 115, and the tobacco 115 can be exposed along a number of exterior surfaces of the product 110A-N. Furthermore, products 110A-N can be packaged in a container 102 with a lid 104 (FIG. 2) along with a plurality of similarly shaped silicone smokeless tobacco products so that an adult tobacco consumer can conveniently select any of the similarly shaped products therein for oral use and receive a substantially identical portion of the tobacco 115. In some embodiments, the silicone smokeless tobacco product 110 or products 110A-N can be wrapped or coated in an edible or dissolvable film, which may be substantially transparent or translucent. The dissolvable film can readily dissipate when the product 110 is placed in an adult tobacco consumer's mouth thereby providing the adult tobacco consumer with the tactile feel of the tobacco 115 along the exterior of the product 110.

The silicone smokeless tobacco product can also include additional elements. In some embodiments, a silicone and smokeless-tobacco composite can be attached to a rod, tube, or stick. For example, FIGS. 5A-5G depict tubes attached to a silicone/smokeless tobacco tips. As shown, a tip containing smokeless tobacco and silicone binder is connected to a tube or rod. FIG. 5A depicts an embodiment having a recorder-shaped tip 510 and a contoured tube 590. The recorder-shaped tip 510 can be composed of the silicone and smokeless tobacco composites discussed above. FIG. 5B depicts a similarly shaped silicone smokeless tobacco product having a plastic recorder-shaped tip 520 that includes a reusable plastic part 522 and a silicone/smokeless tobacco composite part 524. FIG. 5C-5E depicts embodiments having tube shaped tips 530, 540, and 550 having different lengths. FIG. 5D depicts an embodiment having a tapered tube 540. FIGS. 5C-5E each depict different tube or rod embodiments 590, 592, and 594, each having different shapes. FIG. 5E depicts an embodiment having vent holes at non-tip end. FIG. 5F depicts how the tip 530 and tube 590 of FIG. 5C can be attached via a snap fit attachment feature 596. Each of the tubes 592 and 594 of FIGS. 5A-5E can have an attachment features. In some embodiments, a system or kit of different tubes and rods and/or different tips can be packaged together, each having the same type of attachment features. Embodiments having each of the combinations of tips and tubes or rods shown in FIGS. 5A-5E are contemplated. The tube 590 can optionally include flavorants disposed in the tube 590 and adapted to be released when air is drawn through the tube 590. For example, FIG. 5G depicts a tube including flavor beads 582 and a flavor strip 584. The silicone/smokeless tobacco composite can also be applied to a wooden or plastic stick, such as shown in FIG. 5H.

VII. Method of Use

Referring back to FIG. 2, the silicone smokeless tobacco product 110 can be used by removing a silicone smokeless tobacco product 110 from the container 102 and by placing the intact silicone smokeless tobacco product in the adult tobacco consumer's mouth. For example, the adult tobacco consumer can open the container 102 by removing the lid 104. When the adult tobacco consumer removes a silicone smokeless tobacco product 110 from the interior space 103 of the container 102, the adult tobacco consumer can grip the silicone smokeless tobacco product 110 between the adult tobacco consumer's thumb 612 and the index finger 614 and/or other fingers. The silicone smokeless tobacco product 110 retains its integrity as it is gripped with moderate pressure. The product 110 can also be broken into separate pieces if the adult tobacco consumer desires to have a smaller-sized portion of smokeless tobacco.

The adult tobacco consumer can insert the silicone smokeless tobacco product 110 into the adult tobacco consumer's mouth. For example, the adult tobacco consumer can place the silicone smokeless tobacco product 110 between the adult tobacco consumer's lip and the adult tobacco consumer's gingiva (the adult tobacco consumer's gums). Because of the material properties described herein, the product 110 retains its integrity during the gripping and inserting process. After the product 110 is inserted in the mouth, however, the product 110 comes into contact with the inside of the adult tobacco consumer's mouth. The adult tobacco consumer can also apply pressure to the silicone smokeless tobacco product 110 to conform the smokeless tobacco product to the contours of the oral cavity. For example, the adult tobacco consumer can compress the silicone smokeless tobacco product between the lip and the gingiva. The silicone smokeless tobacco product can remain cohesive during and thus reduce the instances of substantial pieces of tobacco floating to undesired portions of the adult tobacco consumer's mouth. Moreover, the presence of the silicone binder in the silicone smokeless tobacco product can also enhance the flavor experience by increasing the duration of the flavor release as compared to loose smokeless tobacco.

The silicone smokeless tobacco products of FIGS. 5A-5H can also be used to placing the silicone/smokeless tobacco composite tip or coating into the adult tobacco consumer's mouth. The rod, tube, or stick end can remain outside of the mouth. In some embodiments, air can be drawn through tube 590.

OTHER EMBODIMENTS

It is to be understood that, while the invention has been described herein in conjunction with a number of different aspects, the foregoing description of the various aspects is intended to illustrate and not limit the scope of the invention, which is defined by the scope of the appended claims. Other aspects, advantages, and modifications are within the scope of the following claims.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed.

What is claimed is:

1. A silicone smokeless tobacco product comprising:

an integrally-molded mixture including, tobacco, at least a portion of the tobacco being exposed along an exterior surface of the product, and an elastic silicone binder in an amount ranging from 25 weight percent to 40 weight percent of the silicone smokeless tobacco product, the elastic silicone binder including a polysiloxane, the elastic silicone binder being cross-linked, wherein the silicone smokeless tobacco product has an oven volatiles content ranging from 50 weight percent to 61 weight percent.

2. The product of claim 1, wherein the integrally-molded mixture further comprises a flavorant.

3. The product of claim 2, wherein the flavorant comprises licorice, wintergreen, cherry and berry type flavorants, Drambuie, bourbon, scotch, whiskey, spearmint, peppermint, lavender, cinnamon, cardamon, *Apium graveolens*, clove, cascarilla, nutmeg, sandalwood, bergamot, geranium, honey essence, rose oil, vanilla, lemon oil, orange oil, Japanese mint, cassia, caraway, cognac, jasmine, chamomile, menthol, ylang-ylang, sage, fennel, piment, ginger, anise, coriander, coffee, mint oils from a species of the genus Mentha, or any combination thereof.

4. The product of claim 1, wherein the elastic silicone binder comprises polydimethylsiloxane.

5. The product of claim 1, wherein the tobacco comprises moist long-cut fermented cured tobacco having a length ranging from 0.1 inches to 1 inch.

6. The product of claim 1, wherein the integrally-molded mixture further comprises cellulosic fibers, the cellulosic fibers being dispersed within the elastic silicone binder.

7. The product of claim 1, wherein the product has a length of less than or equal to 50 millimeters.

8. The product of claim 1, wherein the product has a width less than or equal to 20 millimeters.

9. The product of claim 1, wherein the product has a thickness of less than or equal to 10 millimeters.

10. The product of claim 1, wherein the integrally-molded mixture further comprises cellulose fibers, the elastic silicone binder securing the cellulose fibers.

11. The product of claim 10, further comprising:

nicotine absorbed in the cellulose fibers, the nicotine being configured to be released from the cellulose fibers when the product is placed in an oral cavity of an adult consumer.

12. A silicone smokeless tobacco product comprising:

an integrally-molded mixture including, tobacco, at least a portion of the tobacco being exposed along an exterior surface of the product, and a binder consisting essentially of silicone, the binder being present in an amount ranging from 25 weight percent to 40 weight percent of the silicone smokeless tobacco product, the binder including a polysiloxane, the binder being cross-linked, wherein the silicone smokeless tobacco product has an oven volatiles content ranging from 50 weight percent to 61 weight percent.

13. The product of claim 12, wherein the integrally-molded mixture further comprises a flavorant.

14. The product of claim 13, wherein the flavorant comprises licorice, wintergreen, cherry and berry type flavorants, Drambuie, bourbon, scotch, whiskey, spearmint, peppermint, lavender, cinnamon, cardamon, *Apium graveolens*, clove, cascarilla, nutmeg, sandalwood, bergamot, geranium, honey essence, rose oil, vanilla, lemon oil, orange oil, Japanese mint, cassia, caraway, cognac, jasmine, chamomile, menthol, ylang-ylang, sage, fennel, piment, ginger, anise, coriander, coffee, mint oils from a species of the genus Mentha, or any combination thereof.

15. The product of claim 12, wherein the tobacco comprises moist long-cut fermented cured tobacco having a length ranging from 0.1 inches to 1 inch.

16. The product of claim 12, wherein the integrally-molded mixture further comprises cellulosic fibers, the cellulosic fibers being dispersed within the binder.

17. The product of claim 12, wherein the product has a length of less than or equal to 50 millimeters.

18. The product of claim 12, wherein the product has a width less than or equal to 20 millimeters.

19. The product of claim 12, wherein the product has a thickness of less than or equal to 10 millimeters.

20. The product of claim 12, wherein the integrally-molded mixture further comprises cellulose fibers, the binder securing the cellulose fibers.

21. The product of claim 20, further comprising:

nicotine absorbed in the cellulose fibers, the nicotine being configured to be released from the cellulose fibers when the product is placed in an oral cavity of an adult consumer.

* * * * *